US005148755A

United States Patent [19]

Morales

[11] Patent Number: 5,148,755

[45] Date of Patent: Sep. 22, 1992

[54] UTILITY TRAY FOR ATTACHMENT TO A WALL, OR THE LIKE

[76] Inventor: Benny B. Morales, 2550 S. Cucamonga Ave., Ontario, Calif. 91761

[21] Appl. No.: 615,581

[22] Filed: Nov. 19, 1990

[51] Int. Cl.[5] ..... A47B 5/00

[52] U.S. Cl. ..... 108/47; 108/46; 248/311.2; 248/909

[58] Field of Search ..... 108/25, 26, 47, 46, 108/152; 297/194; 211/88; 248/311.2, 223.4, 224.4, 225.1, 909, 214, 215, 242

[56] References Cited

U.S. PATENT DOCUMENTS

| | | | |
|---|---|---|---|
| D. 303,454 | 9/1989 | Morales | D3/40 |
| 1,956,060 | 4/1934 | De Foe et al. | 108/46 |
| 1,964,500 | 6/1934 | Breiding et al. | 108/46 |
| 2,593,222 | 4/1952 | Tracy | 108/46 X |
| 2,650,870 | 9/1953 | Carpenter | 248/909 X |
| 3,389,883 | 6/1968 | Johnson | 248/311.2 X |
| 3,734,439 | 5/1973 | Wintz | 248/311.2 X |
| 4,557,452 | 12/1985 | Khuong | 248/311.2 X |
| 4,890,353 | 1/1990 | Shannon et al. | 248/909 X |
| 4,978,092 | 12/1990 | Nattel | 248/909 X |

FOREIGN PATENT DOCUMENTS

| | | | |
|---|---|---|---|
| 876088 | 8/1961 | United Kingdom | 108/46 |

*Primary Examiner*—Peter A. Aschenbrenner

[57] ABSTRACT

A utility tray provided for attachment to a wall comprises a horizontal support surface having an upwardly protruding lip attached to and extending above the peripheral edge of the support surface. Two adjacent support arms extend upwardly from a straight portion of the peripheral edge, each support arm ending in a downwardly facing hook extending away from the support surface. A pair of substantially parallel horizontal fingers protrude from the straight portion of the peripheral edge, each finger comprising a number of frangible sectors arranged end to end. One or more sectors can be easily snapped off of the finger so that the finger fits between the horizontal support surface and the wall such that the horizontal support surface maintains a horizontal orientation. Further, a slot opening in at least one of the support arms is shaped to engage an attachment prong of a removable clamp. The clamp is made from a flexible material and, when inserted into the slot opening, is positioned favorably to allow placement of a drinking cup into the clamp, the bottom of the drinking cup being supported upon the horizontal support surface.

3 Claims, 3 Drawing Sheets

UTILITY TRAY FOR ATTACHMENT TO A WALL, OR THE LIKE

FIELD OF THE INVENTION

This invention relates to utility trays. More specifically, this invention relates to a utility tray for attachment to a wall or other vertical structure.

BACKGROUND OF THE INVENTION

A wide variety of utility trays and shelves exist for providing a horizontal support surface adapted for storage of articles thereon and for attachment to a vertical surface, such as a wall, window, or door. Some of these trays, and most shelves, require direct fastening into the vertical surface through use of support brackets with screws, two-sided foam tape, and the like. In many instances, such direct fastening into the vertical surface will damage said surface undesirably. For example, in the instance of a utility tray for a car door, the placement of the tray is usually temporary, and marring of the door or glass window with a direct tray support means is undesirable.

Accordingly, utility trays have been designed with hooks that are placed over the top edge of the vertical surface, thereby supporting the tray without the need to permanently damage or alter the vertical surface. See, for example, U.S. Des. Pat. No. DES. 303,454, to be included in this patent by way of reference, issued on Sep. 19, 1989 to the present inventor, titled "FOOD TRAY FOR USE IN VEHICLES." One problem associated with utility trays of this type are that the support surface of the tray will slant undesirably if the thickness of whichever element defines the vertical surface does not relate well to the size of the hook or hooks of the utility tray. This is certainly undesirable if the object of the utility tray is to prevent items supported by the tray from sliding off, especially when such an item is a liquid container such as a drinking cup.

Consequently, several trays have been designed that enable the tray support to be adjustable to the thickness of the element defining the vertical surface in order to keep the tray horizontal. Other trays have a beverage container support designed into the tray, or a raised lip around the permitter of the tray, to further stabilize supported articles. Yet these designs tend to be unnecessarily complex, requiring multiple parts and assembly.

Clearly a need exists for a utility tray that is easily supported by a vertical surface, is adjustable to the thickness of whatever element defines the vertical surface, is capable of supporting a liquid container firmly and without spillage, and is extremely easy to manufacture. The present invention fulfills these needs and provides further related advantages.

SUMMARY OF THE INVENTION

The present invention is a utility tray for attachment to a wall, or the like. The tray comprises a horizontal support surface having an upwardly protruding lip attached to and extending above the peripheral edge of the support surface. Two adjacent support arms extend upwardly from a straight portion of the peripheral edge, each support arm ending in a downwardly facing hook extending away from the support surface. Further, a pair of substantially parallel horizontally oriented fingers protrude from the straight portion of the peripheral edge, each finger with a number of frangible sectors arranged end to end. One or more frangible sectors can be easily snapped off of the finger so that the finger fits between the horizontal support surface and the wall in a way that the horizontal support surface maintains a horizontal orientation. Further, a slot opening in at least one of the support arms is shaped to accept an attachment prong attached to a removable semi-circular clamp. The clamp is made from a flexible material and, when inserted into the slot opening, is positioned favorably for accommodating a drinking cup therein, the bottom of the drinking cup being supported upon the horizontal support surface.

One advantageous aspect of this invention is that it provides an adjustable horizontal utility tray that hooks over an element defining a vertical surface, such as a door or car window. Another beneficial feature of this invention is that it can be manufactured in one piece using injection molding of a suitable plastic or rubber material, making its manufacture quite simple and consequently less expensive that alternative utility trays. Further, means are provided to securely support a drinking cup or similar beverage container with a simple clamp that is easily manufactured and employed. Still further, these means of supporting a drinking cup are optional to the user, who may remove such means if undesired.

Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE PREFERRED EMBODIMENT

Figures 1, 1A:
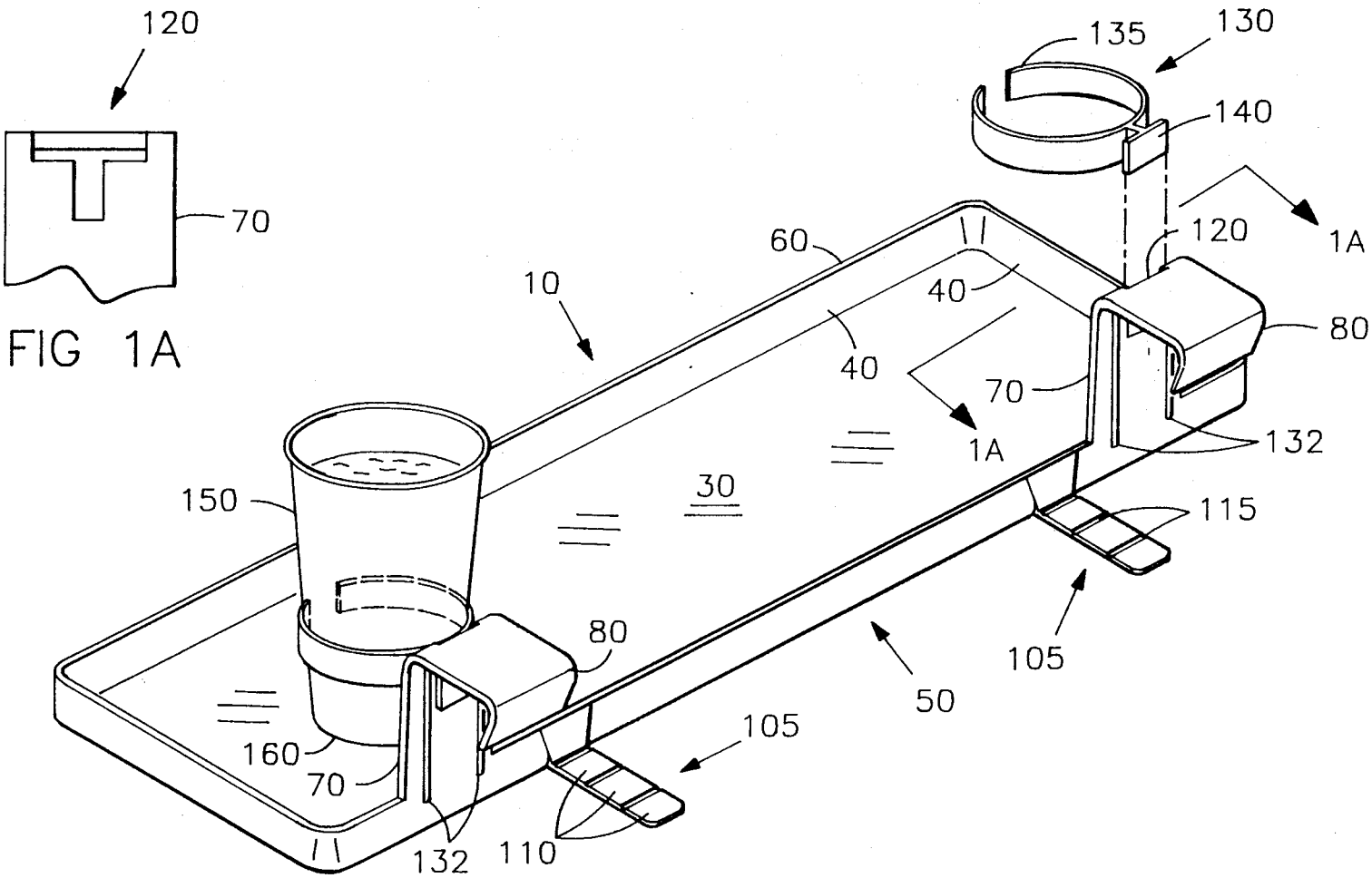
FIG. 1 is a perspective illustration of the rear end of the invention, illustrating a tray, a drinking cup supported by a flexible clamp (partially in phantom outline) attached to said tray, and also depicting another clamp not attached to said tray.
FIG. 1A is a fragmentary front elevational view taken generally along lines 1A—1A of FIG. 1, illustrating a portion of a support arm of the tray of FIG. 1.
Figure 2:
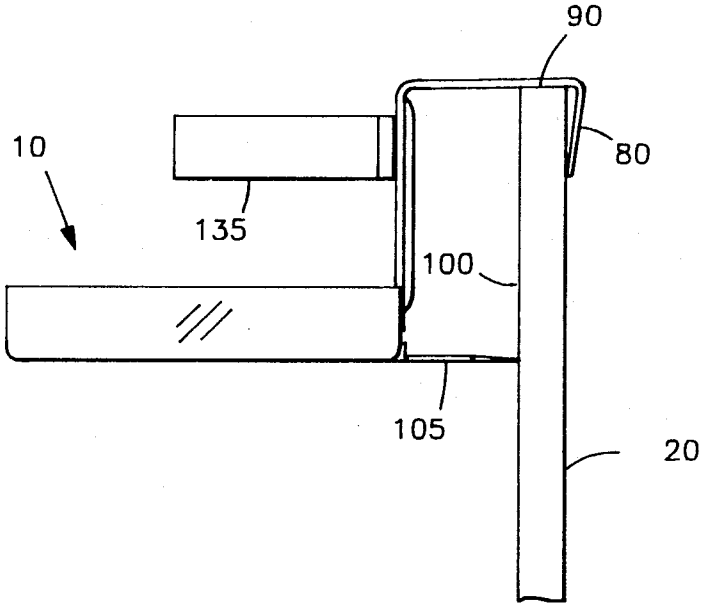
FIG. 2 is a side view of the tray of FIG. 1, illustrating the manner in which the support arms (only one of which is visible in this view) attach the tray to an element defining a vertical surface by hanging therefrom, and the manner in which the fingers (only one of which is visible in this view) brace the tray against the element defining the vertical surface.

As shown in the drawings for purposes of illustration, the present invention resides in a utility tray 10 (FIG. 1) for attachment to a wall 20, shown in FIG. 2. A horizontal support surface 30 has a peripheral edge 40, the peripheral edge 40 having at least one straight portion 50. An upwardly protruding lip 60 extends above the peripheral edge 40. Two adjacent support arms 70 extend upwardly from the straight portion 50, each support arm ending in a downwardly facing hook 80, each of which extends away from the support surface 30.

In one embodiment of the invention, a pair of substantially parallel horizontal fingers 105 protrude from the straight portion 50 and extend toward the wall 20. Each finger has a number of frangible sectors 110 arranged end to end, each sector 110 separated from neighboring sectors 110 by grooves 115. In operation, one or more of the sectors 110 are snapped off of each finger 105 in order to adjust the length of said finger 105 such that the support surface 30 maintains a horizontal orientation, with each finger 105 fitting snugly between the horizontal support surface 30 and a wall surface 100. The grooves 115 are formed deep enough in the fingers 105 to facilitate easy separation of the frangible sectors 110 from the finger 105.

Figure 4:
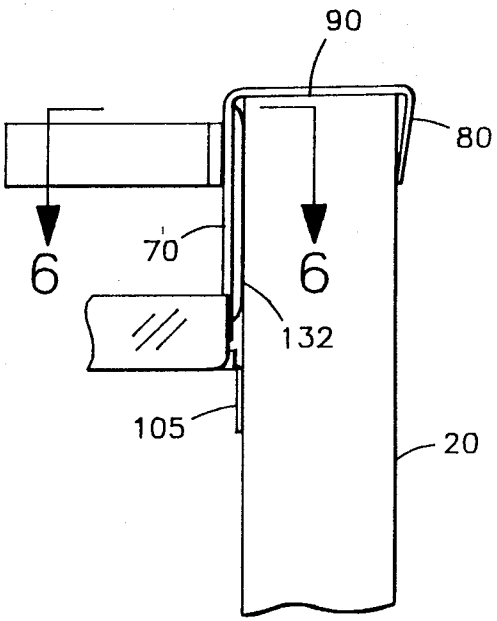
FIG. 4 is a side view of the tray of FIG. 3 with all frangible sectors of the fingers removed, illustrating the manner in which a straight portion of the peripheral edge of the tray braces the tray against a thicker element defining the vertical surface.
Figure 3:
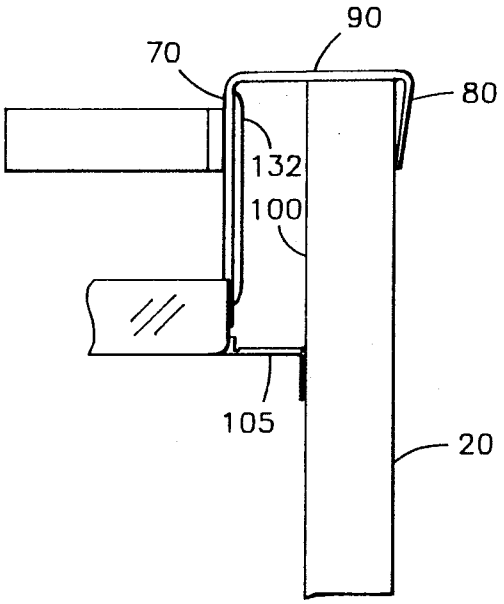
FIG. 3 is a side view of the tray of FIG. 2, illustrating the manner in which the fingers (only one of which is visible in this view), each with one frangible sector removed, brace the tray against a thicker element defining the vertical surface.

In operation, in an embodiment lacking the fingers 105, the utility tray 10 is hung with the hooks 80 placed over a top edge 90 of the wall 20, the straight portion 50 of the peripheral edge 40 laying in contact with the wall surface 100, as illustrated in FIG. 4. In an embodiment with at least one frangible sector 110 comprising each finger 105, the utility tray 10 is hung with hooks 80 placed over the top edge 90 of the wall 20, the ends of the fingers 105 each in contact with the wall surface 100, as illustrated in FIGS. 2 and 3.

The utility tray 10, and all aforementioned components thereof, can be easily manufactured as one piece and from a suitable plastic or rubber material. Very few finishing operations are required, and consequently the manufacturing cost of such a tray 10 is significantly lower than prior trays.

Figure 6:
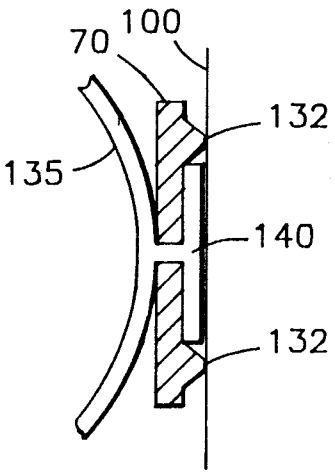
FIG. 6 is a cross sectional view of the clamp and support arm taken generally along lines 6—6 of FIG. 4, illustrating a pair of ribs protruding from one support arm.
Figure 5:
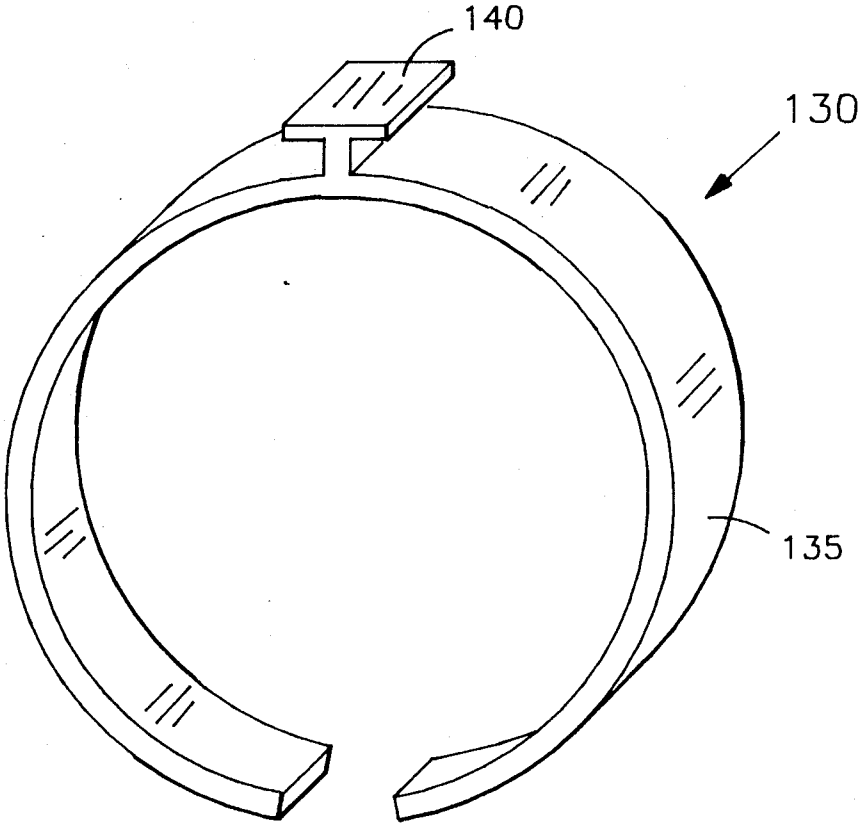
FIG. 5 is a perspective illustration of the flexible clamp of FIG. 1.

In another embodiment of the invention, at least one of the support arms 70 defines a slot opening 120 such that a clamp 130, in the shape of a semi-circular band 135 of flexible material such as rubber or plastic, with an attachment prong 140, may attach thereto. The slot opening 120 and the attachment prong 140 may be "T" shaped, as illustrated in FIGS. 1A and 6. A pair of substantially parallel ribs 71 protrude away from the support surface of each support arm 70 and are spaced to provide insertion clearance of the prong 140 in the slot opening 120. In operation, the prong 140 is fitted into the slot opening 120, thereby enabling the support arm 70 to hold the clamp 130 in a position favorable for accommodating a drinking cup 150 (FIG. 1) therein such that the bottom 160 of the drinking cup 150 is supported upon the horizontal support surface 30.

While the invention has been described with reference to specific embodiments, it is to be clearly understood by those skilled in the art that the invention is not limited thereto. Rather, the scope of the invention is to be interpreted only in conjunction with the appended claims.

What is claimed is:

1. A utility tray for attachment to an element defining a vertical surface, said tray comprising:

means defining a horizontal support surface having a peripheral edge, the peripheral edge having at least one straight portion;

an upwardly protruding lip originating from and extending above the peripheral edge;

at least two support arms extending upwardly from the straight portion, each of the support arms having a slot opening therein and a plurality of substantially parallel, protruding ribs, vertically disposed and protruding away from the support surface, said ribs spaced to provide clearance around the slot opening, each arm ending in a downwardly facing hook, each said hook extending away from the support surface for engagement over the element, the straight portion contacting the vertical surface;

at least one clamp, each one of the at least one clamp comprising a circular band of flexible material having an attachment prong projecting therefrom, the prong adapted to fit into the slot opening, thereby enabling the support arm to hold the clamp in a position suitable for placement of a drinking cup into the band for lateral support of the cup, the cup resting on the horizontal support surface.

2. The utility tray of claim 1 wherein the slot opening is "T" shaped and wherein the prong is "T" shaped, thereby fitting into the slot opening to enable support of the circular band by the support arm.

3. The utility tray of claim 1 further including a pair of substantially parallel, horizontally oriented fingers mounted on the peripheral edge and extending away from said support surface, each finger including at least one frangible sector along its length, wherein one or more frangible sectors can be easily manually snapped off of each finger thereby providing means for adjusting the length of each finger to enable each finger to fit between the horizontal support surface and the element, said fingers providing means for maintaining a horizontal attitude of the horizontal support surface while accommodating elements of various thicknesses, the fingers lying in contact with the element.

* * * * *